US006390808B1

(12) United States Patent
Cakebread

(10) Patent No.: US 6,390,808 B1
(45) Date of Patent: May 21, 2002

(54) GAS FIREPLACE ARTIFICIAL LOG ASSEMBLY

(75) Inventor: Kenneth D. Cakebread, Florence, AL (US)

(73) Assignee: Temco Fireplace Products, Inc., Nashville, TN (US)

( * ) Notice: Subject to any disclaimer, the term of this patent is extended or adjusted under 35 U.S.C. 154(b) by 0 days.

(21) Appl. No.: 09/641,824

(22) Filed: Aug. 17, 2000

(51) Int. Cl.[7] ..... F24C 3/00; F23D 14/00
(52) U.S. Cl. ..... 431/125; 126/512
(58) Field of Search ..... 431/125; 126/512, 126/92 R, 92 AC, 86

(56) References Cited

U.S. PATENT DOCUMENTS 3,291,116 A * 12/1966 Brooks ..... 126/92 R
4,976,253 A * 12/1990 Beal et al. ..... 126/512
5,139,011 A * 8/1992 Moon ..... 126/512
5,271,888 A * 12/1993 Sinsley ..... 264/87
6,006,742 A * 12/1999 Jamieson et al. ..... 126/512
6,045,356 A * 4/2000 Hunter et al. ..... 431/125

* cited by examiner

*Primary Examiner*—Sara Clarke
(74) *Attorney, Agent, or Firm*—Alan Ruderman; Miller & Martin LLP

(57) ABSTRACT

A gas burner log set for a fireplace has a pair of spaced apart ceramic fiber logs with a gas burner therebetween. The rear face of the front log has a substantially flat planar surface angled upwardly toward the front surface of the rear log to form therewith an elongated triangular flame channel having an apex at the top. The burner is spaced from the rear surface of the front log by a small selected distance and the burner has ports which emit gas and create a flame in the flame channel. The front surface of the rear log has an upper portion which overlays the ports of the burner. The log set provides a flame which closely simulates visually the burning of logs and provides a clean burning flame with a minimum amount of carbon monoxide.

8 Claims, 2 Drawing Sheets

GAS FIREPLACE ARTIFICIAL LOG ASSEMBLY

BACKGROUND OF THE INVENTION

This invention relates to a gas-fired artificial log assembly for a fireplace, and more particularly to a gas log assembly which provides a flame that closely simulates visually the burning of logs including realistic flame colors and also results in a reduction in the amount of carbon monoxide generated.

Gas burning fireplaces almost invariably have some sort of artificial logs so as to simulate the burning of logs and the appearance of an actual wood burning fireplace. Artificial logs formed from a refractory material such as ceramic fibers are known and have been used for some time. When heated to temperatures above approximately 1470° F., such logs have a visible glow simulating the appearance of an actual burning wood log.

There has been a substantial amount of effort in the prior art directed toward artificial log assemblies known as log sets, which produce the visible effects of burning logs including the red, blue and yellow colorations as the burning gas creates a flame that dances and jumps against the artificial logs. Examples of such log sets are illustrated in U.S. Pat. Nos. 5,069,200 and 5,388,566. It is therefore readily seen that efforts have been made in the prior art toward improving the output of gas log sets so that visually the logs appear as actual burning logs and the flames appear to be realistic of such burning logs.

One of the problems for which the prior art has not provided a complete solution is that of reducing the undesirable products of combustion resulting from the incomplete combustion of the gas such as, for example, carbon monoxide. This is particularly important where the log sets are used in unvented fireplaces which have oxygen depletion safety features that shut off the flow of fuel when the oxygen level in the environment of the fireplace drops below a certain value, such as for example, 18 percent.

SUMMARY OF THE INVENTION

Consequently, it is a primary object of the present invention to provide a gas burner log set which provides a visually realistic burning flame and glow on at least one of the logs while reducing carbon monoxide and eliminating sooting problems.

It is another object of the present invention to provide a gas burner log set including at least a pair of ceramic fiber logs in which the gas to air ratio is optimized to produce a pronounced glow of the ceramic fiber log surface and a low amount of carbon monoxide.

It is a further object of the present invention to provide a gas burner log set having at least two ceramic fiber logs with a gas burner therebetween, the front one of the logs having a substantially smooth planar rear surface on at least a portion thereof inclined angularly relatively toward the front surface of the rear of the logs to provide an elongated substantially triangular flame guide channel, the burner outlet ports being directed to provide the flow of gas toward the front surface of the rear of the logs and there being an air gap between the burner and the rear surface of the front one of the logs.

Accordingly, the present invention provides a log set for a gas burning fireplace which includes a pair of spaced apart ceramic fiber logs having a gas burner disposed between the logs and directing gas and thus the flame toward the front surface of the rear of the logs, at least a portion of the rear surface of the front of the logs being a substantially smooth planar ramp angularly inclined upwardly toward the front rough textured surface of the rear log to form an elongated substantially triangular flame channel with an apex at the top which directs the flame onto the front surface of the rear log, and spaced from the burner to form an air space therebetween. The air space between the burner and the rear angular surface of the front log is selected to provide blue flames that burn clean, hotter and with increased intensity against the front surface of the rear log as the velocity of the flame increases as it moves upwardly toward the apex of the flame channel. With this construction, the gas/air ratio may be optimized to produce a pronounced glow of the ceramic fiber rear log front surface simulating a highly desirable glowing coal effect. Even distribution of mixing air is maintained between the smooth planar ramp surface and the burner ports thereby resulting in improved combustion and elimination of sooting problems.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
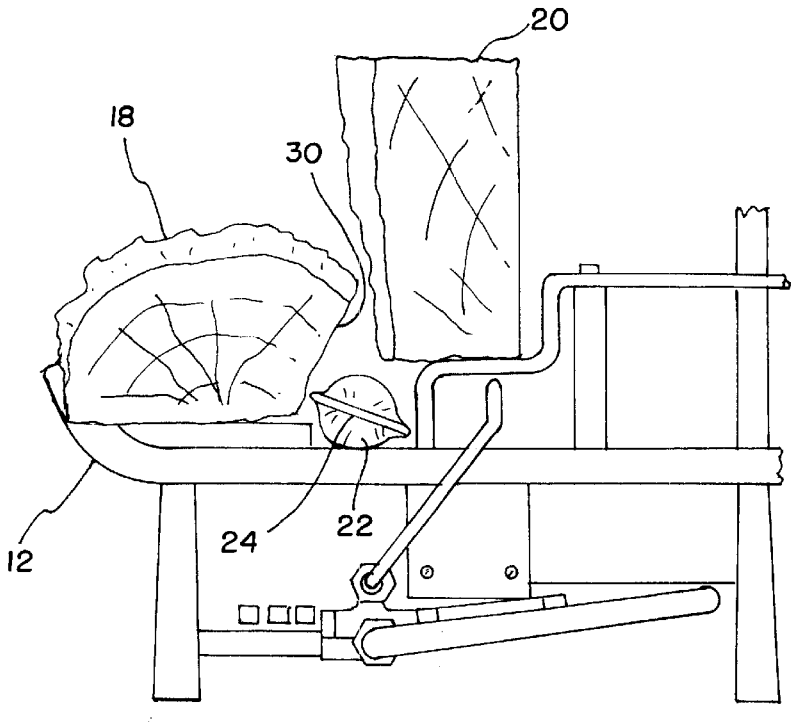
FIG. 1 is a side elevational view of a log set constructed in accordance with the principles of the present invention.
Figure 3:
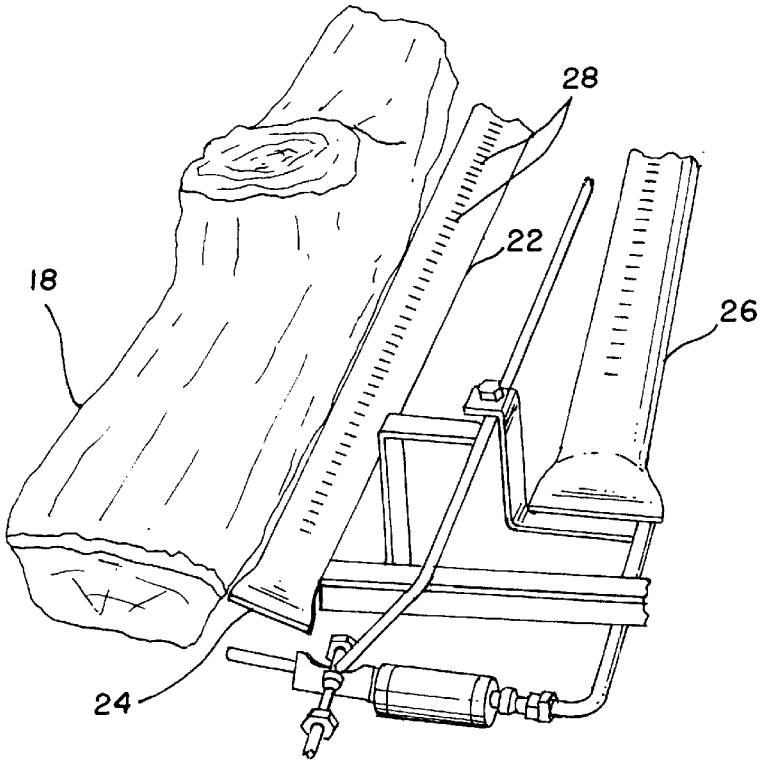
FIG. 3 is a top perspective view of the log set with the rear log removed and looking toward the rear of the front log.
Figure 2:
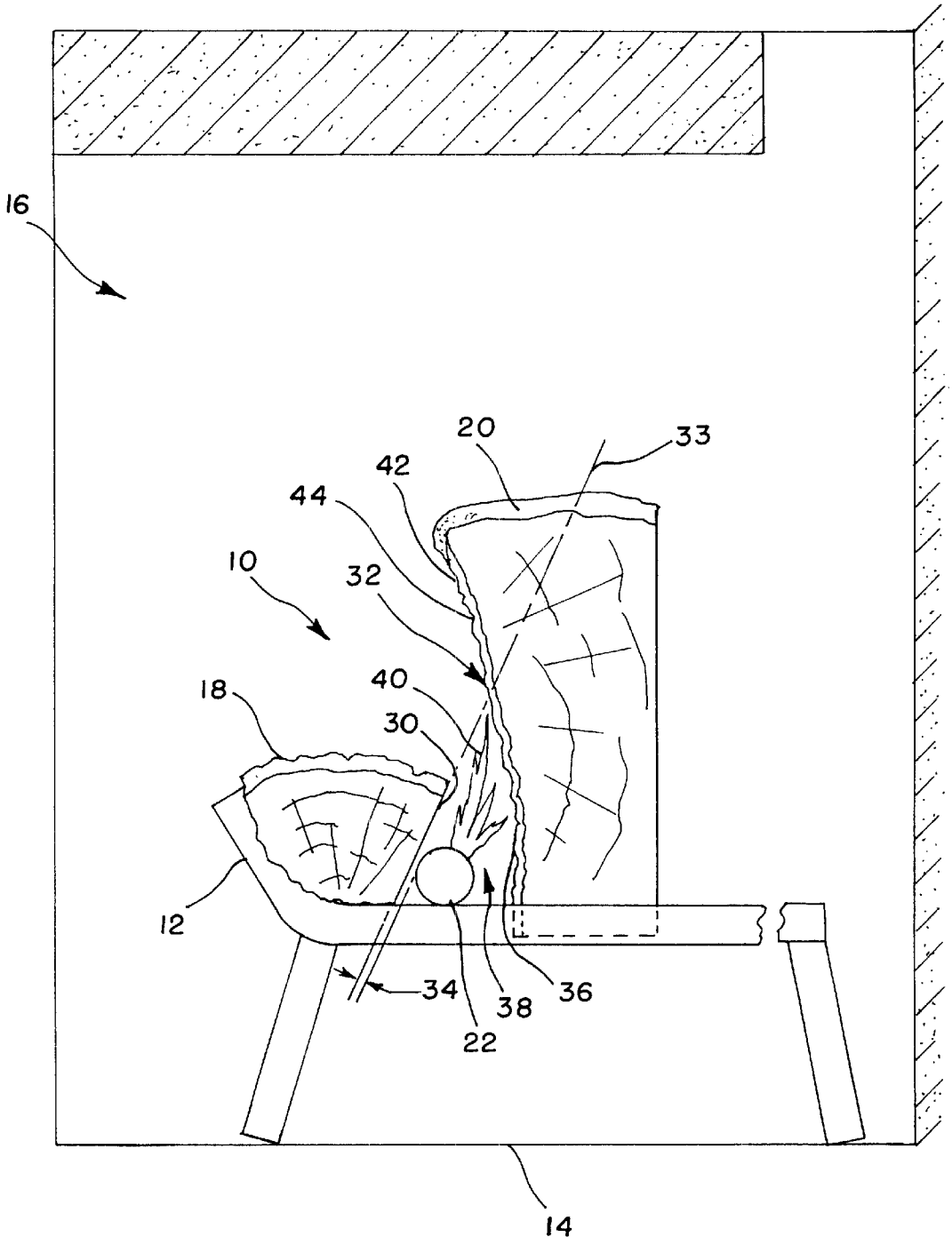
FIG. 2 is a vertical cross-sectional view taken through the log set illustrated in FIG. 1 spaced from the end and depicting a flame.

Referring to the drawings a log set 10 constructed in accordance with the present invention is illustrated mounted on a conventional grate 12 which rests on a floor 14 within a fireplace 16. The log set includes at least two logs 18, 20, and although there may be further logs mounted in the rear of the log 20, the present invention concerns the front log 18 and the adjacent log 20. A burner 22 comprising an elongated metal tube closed at its ends 24 (only one of which is illustrated) as by crimping the ends flat is mounted on the grate intermediate the logs 18, 20. If there are additional logs in the log set to the rear of the log 20, there preferably would be another burner 26 behind the log 20. Each burner tube 22, and 26 if there is a second burner, includes a multiplicity of spaced apart outlet slits 28 forming ports extending the length of the burner adjacent the crimped ends and is fed with gas fuel such as natural gas or propane or other combustible gas from beneath the grate, the gas being fed from an outside source with the fuel.

Each log 18, 20 conventionally comprises ceramic fiber. However, the configuration of the rear surface 30 of the front log 18, the position of the burner tube 22, and the configuration of the front surface 32 of the second or rear log 20 of the two log set is significant and provides the significant improvement that the invention has over the prior art. Thus, the rear surface 30 of the front log is a smooth substantially flat planar surface which is inclined upwardly and rearwardly at an angle toward the front surface 32 of the rear log 20. Thus, the plane 33 of the surface 30 intersects the front 32 of the rear log 20 above the top of the front log. Moreover, except at the crimped ends which are closely adjacent or even touching or abutting the surface 30, the burner tube 22 is spaced a small distance or gap 34 from the surface 30. This gap 34, which has been found to optimally be in the order of ¼ inch +/−⅛ inch, i.e., ⅜ of an inch to ⅛ of an inch, depending on BTU input of the burner, provides a regulated air space for directing air flow from the burner tube and the rear surface of the front log so that the resulting blue flames burn clean, i.e., without sooting and with less carbon monoxide, hotter and with increased velocity against the front surface 32 of the rear log 20.

The front face 32 of the rear log 20 has a rough texture with a configuration which at the bottom 36 spaced oppositely to and laterally from the rear surface 30 of the front log 18, and forms a virtual substantially triangular cross-sectional configuration with the flat rear surface 30 of the front log so that an elongated triangular shaped channel 38 is created which forms the flame channel of the flames 40 resulting from the burning of the gasses emitted from the burner tube slits. This triangular flame channel 38 narrows at the upper end, i.e., the apex of the virtual triangle is at the top. Thus, the air flowing upwardly through the space 34 and the flames produced by the burning increase in velocity as they flow upwardly through the funnel formed by the flame channel.

The upper portion 42 of the front surface 32 of the rear log 20 is contoured so that it overlays the burner slits 28. Thus, the flames 40 impinge on the front face 32 of the log 20 to form a glow area 44 on the log 20 simulating the glowing coal effect that is highly desirable in the fireplace industry. The combustion gases against the smooth flat rear surface 32 of the front log 18, the controlled gap 34 between the surface 32 and the burner tube 22, and the rough texture with the overlying portion 42 of the front surface 32 of the rear log 20 provides a substantial reduction in the amount of carbon monoxide produced relative to the prior art while providing a cleaner hotter blue flame and a glowing coal effect on the front surface of the rear log. It has been found that if the front surface of the rear log and/or the rear surface of the front log is a material other than ceramic fiber, a quenching of the flame results causing increases in the amount of carbon monoxide formed.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

10 log set
12 grate
14 floor
16 fireplace
18 logs
20 logs
22 burner
24 ends
26 burner
28 outlet slits
30 rear surface
32 front surface
34 gap
36 bottom
38 channel
40 flames
42 upper portion
44 glow area Having thus set forth the nature of the invention, what is claimed herein is:

1. A gas burner log set for a fireplace positionable on a support comprising at least two artificial logs and a gas burner positioned intermediate said logs, a first of said logs being positioned in front of a second of said logs, said first log having a substantially flat smooth planar rear surface facing and inclined at an angle upwardly and rearwardly such that the plane of said surface intersects said second log, said burner comprising an elongated tube with a plurality of gas emitting ports on a periphery thereof extending between ends of said tube, said burner tube being positioned a selected distance from said rear surface of said first log to form an air gap, said second log having a rough texture front facing surface comprising ceramic fiber and having a lower surface portion which together with said rear planar surface of said first log substantially forms a triangular flame channel therebetween with an apex at the top, said burner being disposed in said channel with said ports substantially directed towards said apex, and the front facing surface of said second log has an upper portion disposed above said first log and overlays said burner ports.

2. A gas burner log set as recited in claim 1, wherein said air gap is ¼ of an inch +/−⅛ of an inch.

3. A gas burner log set as recited in claim 2, wherein the ends of said burner are crimped flat and abut the rear surfaces of said first log.

4. A gas burner log set as recited in claim 3, wherein said rear surface of said first log comprises ceramic fiber.

5. A gas burner log set as recited in claim 1, wherein the ends of said burner are crimped flat and abut the rear surface of said first log.

6. A gas burner log set as recited in claim 1, wherein said rear surface of said first log comprises ceramic fiber.

7. A gas burner log set as recited in claim 6, wherein said first and second logs comprise ceramic fiber.

8. A gas burner log set for a fireplace positionable on a support comprising at least two artificial logs and a gas burner positioned intermediate said logs, a first of said logs being positioned in front of a second of said logs, said first log having a substantially flat smooth planar rear surface facing and inclined at an angle upwardly and rearwardly such that the plane of said surface intersects said second log, said burner comprising an elongated tube with a plurality of gas emitting ports on a periphery thereof extending between ends of said tube, said burner tube being positioned a selected distance from said rear surface of said first log to form an air gap, said air gap being ¼ of an inch +/−⅛ of an inch, said second log having a rough texture front facing surface comprising ceramic fiber and having a lower surface portion which together with said rear planar surface of said first log substantially forms a triangular flame channel therebetween with an apex at the top, and said burner being disposed in said channel with said ports substantially directed towards said apex.

* * * * *